US009115477B2

(12) United States Patent
Mcmillan

(10) Patent No.: US 9,115,477 B2
(45) Date of Patent: Aug. 25, 2015

(54) MACHINE AND METHOD FOR FORMING AN IN GROUND GRANULAR COLUMN

(76) Inventor: Jaron Lyell Mcmillan, Canterbury (NZ)

( * ) Notice: Subject to any disclaimer, the term of this patent is extended or adjusted under 35 U.S.C. 154(b) by 42 days.

(21) Appl. No.: 14/009,841

(22) PCT Filed: Apr. 1, 2012

(86) PCT No.: PCT/IB2012/051585

§ 371 (c)(1),
(2), (4) Date: Oct. 4, 2013

(87) PCT Pub. No.: WO2012/137118

PCT Pub. Date: Oct. 11, 2012

(65) Prior Publication Data

US 2014/0023443 A1 Jan. 23, 2014

(30) Foreign Application Priority Data

| | | |
|---|---|---|
| Apr. 4, 2011 | (NZ) | 592051 |
| Apr. 4, 2011 | (NZ) | 592052 |
| Apr. 27, 2011 | (NZ) | 592486 |
| Jul. 7, 2011 | (NZ) | 593936 |

(51) Int. Cl.
*E02D 3/08* (2006.01)

(52) U.S. Cl.
CPC ..... *E02D 3/08* (2013.01)

(58) Field of Classification Search
CPC ..... E02D 3/08
USPC ..... 405/231, 232, 252.1, 253; 114/393, 394
See application file for complete search history.

(56) References Cited

U.S. PATENT DOCUMENTS

| | | | | |
|---|---|---|---|---|
| 5,279,502 | A | 1/1994 | Goughnour | |
| 6,402,432 | B1 * | 6/2002 | England et al. | 405/232 |

FOREIGN PATENT DOCUMENTS

| | | | |
|---|---|---|---|
| FR | 2683561 | A1 | 5/1993 |
| JP | 59141622 | A | 8/1984 |
| JP | 62228514 | A | 10/1987 |
| JP | 02167918 | A | 6/1990 |
| WO | 2010029871 | A1 | 3/2010 |

OTHER PUBLICATIONS

PCT Search Report dated Jul. 6, 2012 of Patent Application No. PCT/IB2012/051585 filed Apr. 1, 2012.
EP Search Report dated Oct. 22, 2014 of Patent Application No. EP12768257, 4 pages.

* cited by examiner

*Primary Examiner* — Tara M. Pinnock
(74) *Attorney, Agent, or Firm* — Maine Cernota & Rardin

(57) ABSTRACT

A drill assembly for forming in ground granular columns without the need for vibratory compaction, the drill assembly includes a first drill (10) and a second drill (11), where the first drill is a tube (7), and the second drill includes a drill flight (26), wherein the first and second drills are concentric, and the second drill (11) is configured to lie at least partially within the first drill (10); such that the drill assembly is configured to form the granular column with primarily vertical compaction; when the drill assembly arrives at the required depth, the second drill (11) is used to feed an aggregate to a lower terminal end of the drill assembly, thus forming the granular column as the drill assembly is withdrawn.

15 Claims, 11 Drawing Sheets

MACHINE AND METHOD FOR FORMING AN IN GROUND GRANULAR COLUMN

This application is a national phase application filed under 35 USC §371 of PCT Application No. PCT/IB2012/051585 with an International filing date of Apr. 1, 2012 which claims priority of NZ Patent Application 592051 filed Apr. 4, 2011, NZ Patent Application 592052 filed Apr. 4, 2011, NZ Patent Application 592486 filed Apr. 27, 2011, NZ Patent Application 593936 filed Jul. 7, 2011. Each of these applications is herein incorporated by reference in their entirety for all purposes.

TECHNICAL FIELD

The present invention is a machine and method for forming a granular column (one specific variation being a stone column), that is, a column of aggregate material in the ground for drainage and/or support, or for improving the ground by densification.

BACKGROUND ART

Stone, or granular, columns are formed in the ground to provide a foundation (increase the load bearing properties of the ground) and/or improve drainage.

There are a variety of methods for creating granular columns, in one method the hole is drilled (a poker can be inserted and withdrawn in some instances) and the drill extracted, the hole is part filled with stone aggregate (10 mm to around 75 mm). A cone shaped vibrator is then used to compact this fill as more is added until the column is formed. As a hole needs to be drilled first this method is not suitable in collapsing ground; the walls of the hole collapse which may prevent the column from being formed or the column can be contaminated during construction. In addition any fine material may be blown out creating a spoil problem. The method does not work with high ground water levels.

To overcome some of the weaknesses of the above mentioned method it is possible to feed the stone to the underside of the vibrator and withdraw the vibrator as the stone fills the void. The fines blowout can still be a problem but this can be reduced by using compressed air. The column can still be contaminated with ground material and some ground types can be hard to penetrate. One significant drawback to this method is the equipment cost.

To improve the quality control of the granular column a number of solutions have been proposed. For example U.S. Pat. No. 5,279,502 describes a hollow tube which includes an impellor at the tip. In use the tube penetrates the ground and, when at the desired depth crushed stone (aggregate) is fed through the centre of the tube and expelled through the impellor. The impellor is designed to distribute the crushed stone fed through the hollow tube out radially and as such is not suitable for 'drilling the hole'. In use the impellor forces the stone out radially and forms an essentially radially compacted granular column as it is withdrawn. The author indicates that by applying the compaction forces in this way the granular column can be formed faster and with more predicable properties. The method is directed to applications with soft cohesive soils though a variation can allow it to be used with harder soils. The method is not really suitable for ground which includes high levels of non-cohesive materials, such as sand.

Any discussion of the prior art throughout the specification is not an admission that such prior art is widely known or forms part of the common general knowledge in the field.

The present invention provides a machine and/or method for forming a granular column that is intended to overcome one or more of the deficiencies of the methods mentioned above, or provide the consumer with a useful choice.

The present invention intends to provide a machine and/or method that forms in ground granular columns without the need for vibratory compaction, and primarily (greater than about 66%) vertical compaction.

DISCLOSURE OF INVENTION

The present invention provides a drill assembly for forming in ground granular columns, the drill assembly includes a first drill and a second drill.

Preferably the drill assembly forms in ground granular columns without the need for vibratory compaction.

In a highly preferred form the first drill is a tube, and the second drill includes a drill flight, such that said first and second drill are concentric, and the second drill is configured to lie at least partially within the first drill, wherein the drill assembly is configured to form the granular column with primarily (greater than about 66%) vertical compaction.

In a highly preferred form the invention is a drill assembly for forming in ground granular columns without the need for vibratory compaction, said drill assembly includes a first drill and a second drill, where the first drill is a tube, and the second drill includes a drill flight, wherein said first and second drills are concentric, and the second drill is configured to lie at least partially within the first drill; such that the drill assembly is configured to form the granular column with primarily vertical compaction In a highly preferred form the drill flight is part of an auger.

Preferably the first drill includes a first section, wherein the first section includes a first end which is coincident with a terminal end of the first drill. In a highly preferred form the second drill includes a primary section and a secondary section where the primary section includes the auger with the drill flight. Preferably said primary section is configured to be adjacent the first section of the first drill during insertion of the drill assembly.

Preferably the drill flight includes a first terminal end which is closest to the secondary section. Preferably between the primary section and the secondary section there is an intermediate section, such that the first terminal end of the drill flight is coterminous with one distal end of the intermediate section. In a preferred form the intermediate section includes a fourth flight. Preferably one distal end of the fourth flight is coterminous with the first terminal end of the drill flight. In a highly preferred form the outside diameter of the fourth flight is less than the outside diameter of the drill flight.

Preferably the drill flight extends between 300 mm and 1.5 m along the second drill.

Preferably the second drill includes a blanking means configured to prevent ground material from entering the second drill.

In a preferred form the first section includes a first flight. In a preferred form the first drill includes a second section and a third section, such that the third section is at an opposite terminal end of the first drill to the first section, and the second section lies between the first section and the third section.

In the alternative preferred form the second section includes a second flight. such that the first flight has the opposite handedness to the second flight.

In an alternative preferred form there is no first flight and the second section includes a second flight Preferably the first section includes an expanded section which is a section of the first drill that has a greater diameter than the second section. Preferably the expanded section is configured, when the first drill is in use, to reduce the skin friction of the drill assembly.

Preferably the drill flight has the same handedness as the second flight. Alternatively the drill flight has the same handedness as the first flight. In a further preferred form the drill flight has the opposite handedness as the first and/or second flight.

Preferably the first and second drills are configured to be driven by drive devices, either independently or otherwise. In a highly preferred form the first drill is configured to be driven the opposite direction to the second drill.

In a further preferred form the first drill is driven by a first drive device and the second drill is driven by a second drive device.

Preferably the first and second drills are driven by a single drive means through a gearbox section.

In a highly preferred form the third section includes a gearbox section, the gearbox section forming the opposite terminal end of the first drill.

Preferably the gearbox section includes a first gear, one or more intermediate gears and a second gear configured to engage and enmesh to form a planetary gear set; such that the first gear is attached to the first drill, the second gear is concentric to the first gear and attached to the second drill, and the intermediate gear(s) are configured to transfer the drive from the first gear to the second gear. Preferably the gearbox is configured to drive the second gear such that, when driven, the volumetric flowrate of the second drill is greater than, or equal to, the volumetric flowrate of the first drill. Preferably the volumetric flowrate of the second drill is at least 1.0× the volumetric flowrate of the first drill. In a highly preferred form the volumetric flowrate of the second drill is at least 2× the volumetric flowrate of the first drill.

In a highly preferred form the gearbox section includes a star epicyclic.gear; with the first gear being the annular or ring gear, the intermediate gears being the planetary gears and the second gear being the sun gear.

Preferably the second drill includes a blanking means to configured to prevent the ground from entering the second drill or drilling assembly.

In one preferred embodiment the first, intermediate and second gears are permanently enmeshed. In an alternative embodiment the intermediate and second gears are configured to engage as the drill assembly is withdrawn from the ground.

In one embodiment the opposite terminal end of the first drill is coincident with a base of a hopper which is configured to feed aggregate through to the second drill.

Preferably the aggregate is at least 1 mm in size. In a highly preferred form the aggregate is at least 5 mm in size.

Preferably when the third section includes a gearbox section it also includes an inlet section, where said inlet section includes at least one inlet, where an inlet is an aperture through the third section of the first drill that is configured to allow aggregate in the hopper to reach the second drill.

Preferably the second drill includes a primary section and a secondary section, where the drill flight is located on the primary section, which is configured to be adjacent the first section of the first drill. Preferably the second drill includes a drill point coincident with a terminal end of the second drill which is configured to be the first part of the second drill to engage with the ground. Preferably the drill point is configured to assist the insertion of the drill assembly into the ground.

The present invention also includes a method of forming a granular column using the drill assembly, in which the first drill is driven by the associated drive device and the drive assembly is pushed into the ground forming a hole, when it arrives at the required depth the second drill is used to feed aggregate to the end of the first section, forming a granular column as the drill assembly is withdrawn.

Preferably as the drill assembly is inserted it forms a compressed wall of spoil around the edge of the hole. Preferably the volumetric feed rate of the first drill and the volumetric feed rate of the second drill in combination with the withdrawal rate are controlled to determine the properties of the compressed wall and the final granular column.

A further alternative preferred method of using the drill assembly includes the following steps:

Step A: Insert drill assembly into the ground to the desired depth to form a hole;

Step C: Feed aggregate through the drill assembly to the base of the hole;

Step D: Withdraw the drill assembly whilst controlling the feed rate and possibly other parameters to form a granular column with the desired characteristics.

Preferably the parameters controlled and/or measured includes one or more of the following: the torque applied to the first drill, the second drill and/or the drill assembly, the aggregate feed rate, the drill assembly withdrawal rate, the rotational speed of each drill or the drill assembly.

Preferably in step A the drill assembly is operated and/or configured to prevent a detrimental amount of ground material passing along the drill flight or otherwise finding its way into the drill assembly.

Preferably between step A and C step B is undertaken, where step B is

Step B: Adjust the position of the drills until the first terminal end is spaced apart from the first end.

Preferably in step B the first end and terminal end are spaced apart by between −100 mm and 450 mm.

Preferably as the drill assembly is inserted it forms a compressed wall of spoil around the edge of the hole. Preferably the volumetric feed rate of the first drill and the volumetric feed rate of the second drill in combination with the withdrawal rate are controlled to determine the properties of the compressed wall and the final granular column.

The present invention also includes a granular column formed by the drill assembly or a method described.

Preferably the drill assembly includes means, or is configured to be operated such, that, in use, the ingress of ground material into the first drill is below a level likely to contaminate the completed granular column.

BRIEF DESCRIPTION OF DRAWINGS

By way of example only, a preferred embodiment of the present invention is described in detail below with reference to the accompanying drawings, in which.

DEFINITIONS

Aggregate: when used herein is construction aggregate above about 0.1 mm in size (including sand, stones, crushed rock, crushed concrete, slag, etc).

Auger: when used herein includes a flight without a central shaft, similar to a corkscrew.

Detrimental amount of ground material: when used herein is an amount of ground material sufficient to affect the integrity of a granular column, this will be dependent on the granular column to be formed and the properties of the ground material.

Flight: when used herein is a strip of material following a helical path like a spiral staircase.

Outside diameter: When referring to objects with a cross section that is not circular this is intended to mean the circle scribed by the longest line segment from the centre to the periphery of that object.

Tube: when used herein a tube is meant to indicate a long hollow member whose outer cross sectional profile may be circular or any other shape (triangular, square, hexagonal etc) and whose inner cavity is circular (or approximately circular/elliptical) in cross section.

Please note the drawings are representative only and the relative dimensions may be exaggerated for clarity.

BEST MODE FOR CARRYING OUT THE INVENTION

Figure 1:
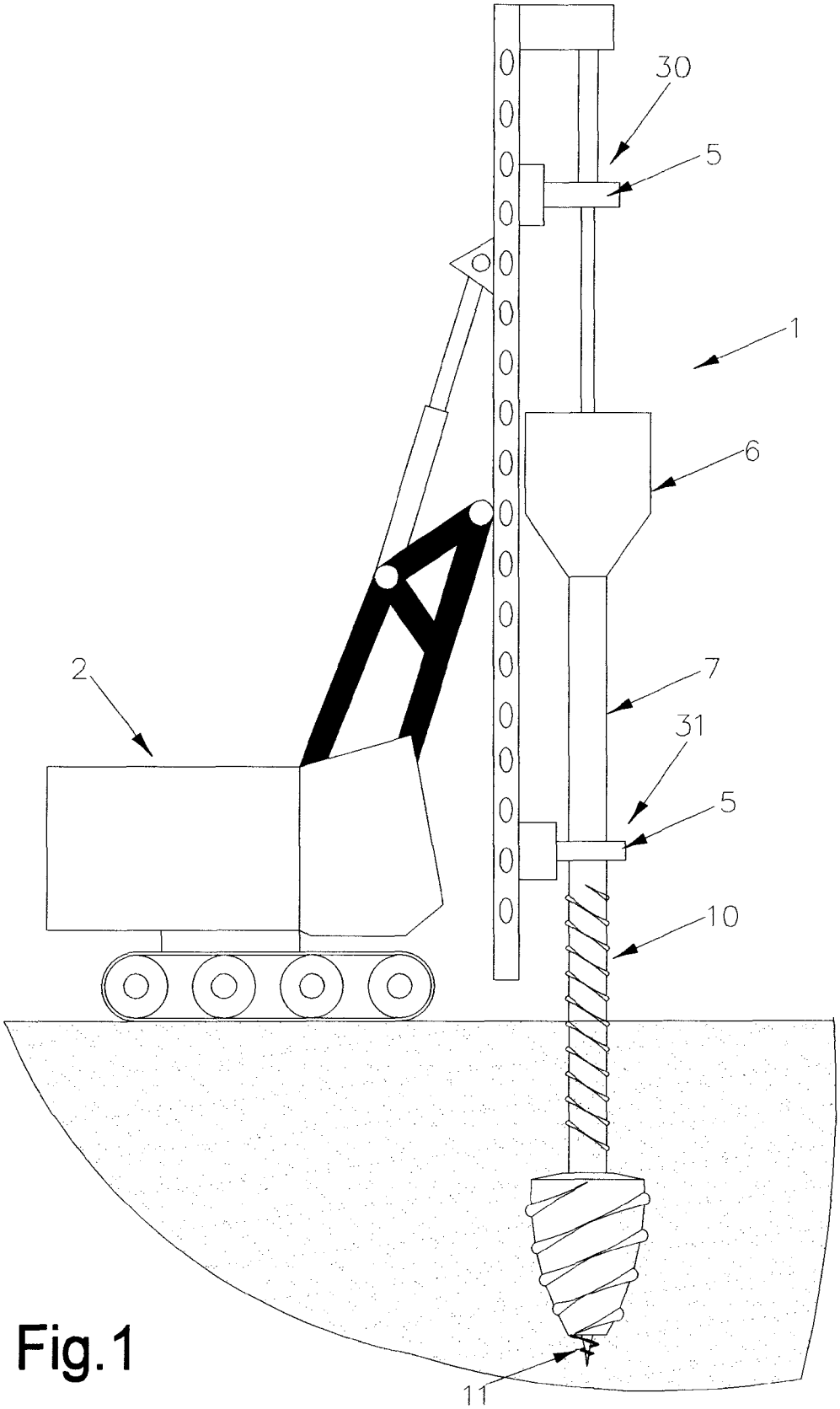
FIG. 1 is a side figurative view of the machine for forming granular columns mounted onto to a crane/excavator, as the drill is being inserted into the ground.

Referring to FIG. 1 a machine (1) for forming a granular column in the ground is shown mounted on an excavator/crane (2). The crane/excavator (2) is of a known type used in the industry and it provides the support and services to the machine (1). The machine (1) includes one or more drive device (5), a hopper (6) and drill assembly (7). The drill assembly (7) includes a first drill (10) and a second drill (11). The, or each, drive device (5) is a standard drive means, it could be a hydraulic motor, electric motor, diesel (or any other fuel) engine or other means of directly or indirectly rotationally driving an item.

Figure 2:
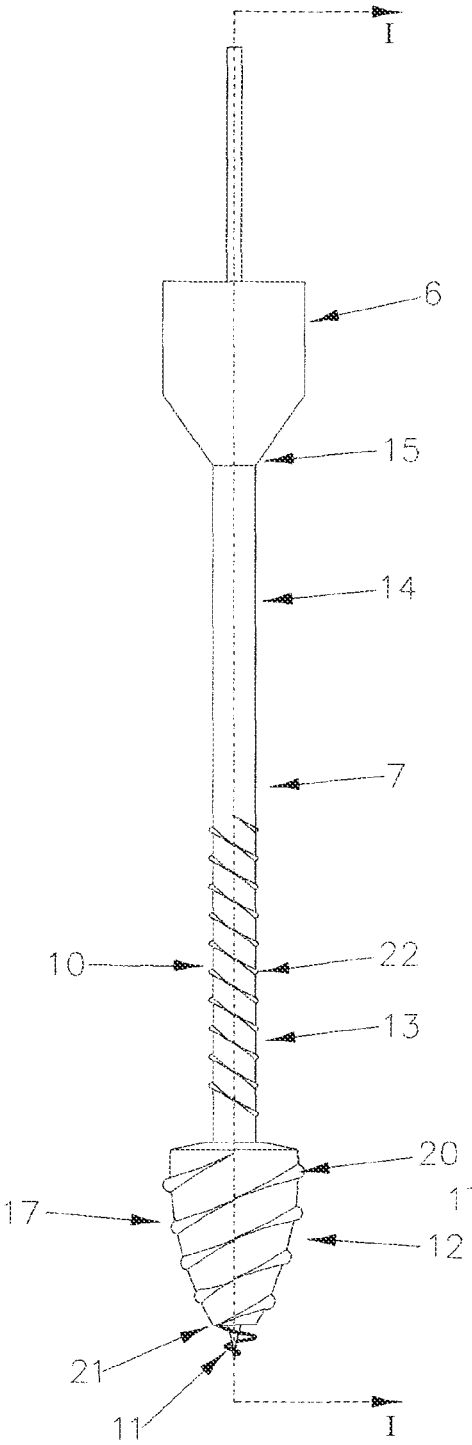
FIG. 2 is a side view of the drill assembly and hopper.

Referring to FIG. 2 the drill assembly (7) with hopper (6) is shown separated from the excavator/crane (2). The first drill (10) is essentially a tube with a first section (12), a second section (13) and a third section (14), such that the first and third sections (12,14) are at opposite ends of the first drill (10) and are connected by the second section (13). One end of the third section (14) is coterminous with the base (15) of the hopper (6).

The hopper (6) is a container for the aggregate to be used to form the granular column. In this case it is essentially a truncated cone with a cylindrical section extending from the cone's base, the truncated end forming the base (15) of the hopper (6).

The first section (12) includes an expanded section (17) of the drill assembly (7) which is larger in outside diameter than the second section (13). The first section (12) includes an optional first flight (20) attached to the outer surface of said first section (12). The first flight (20) runs in the same direction as a right hand thread. The outside diameter of the first section (12) smoothly transitions from the outside diameter of a first end (21) of the first section (12), where the first end (21) is coterminous with a terminal end of the first drill (10), to the outside diameter of the expanded section (17), it then smoothly transitions to the outside diameter of the second section (13). In one form the first section (12), without the first flight (20) attached, is essentially two truncated cones, bases facing, with a cylinder inserted between them.

The second section (13) includes a second flight (22) attached to the outer surface of the second section (13). The second flight (22) runs the same direction as a left hand thread. The outer diameter of the second flight (22) is less than or equal to the outer diameter of the first flight (20). Preferably the outer diameter of the second flight (22) is the same diameter as the first flight (20).

Figure 3:
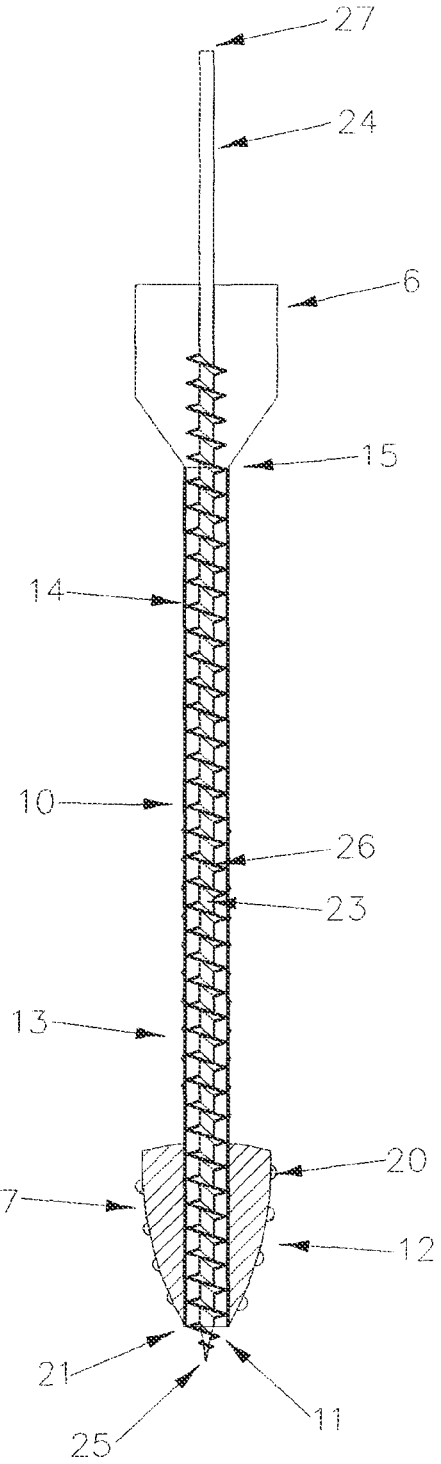
FIG. 3 is a cross sectional view of a first embodiment, along I-I in the direction of arrows I-I, of the drill assembly and hopper.

Referring to FIG. 3 the first embodiment of the drill assembly (7) is shown in cross section, along the line I-I in FIG. 2 in the direction of the arrows. The second drill (11) is essentially an auger (a flight attached to a shaft, though the shaft may not extend through the centre of the flight) dimensioned to fit within a hollow inside the first drill (10), the first drill (10) and second drill (11) are longitudinally concentrically aligned. The second drill (11) includes a primary section (23), secondary section (24), a drill point (25) and drill flight (26), the drill flight (26) is in effect a third flight. The drill flight (26) is attached to the outer surface of the primary section (23). The drill flight (26) runs in the same direction as a left hand thread. The drill point (25) is located at a terminal end of the second drill (11), and is a tapered portion of said second drill (11) forming the end of the primary section (23). The outer diameter of the second drill (11) is a minimum at the drill point (25). The secondary section (24) includes a drive end (27) which is located at the opposite end of the second drill (11) to the drill point (25), the drive end (27) extends beyond the edge of the hopper (6).

In this first embodiment, as shown in FIG. 1, there are two separate, independent, drive devices (5), a first drive device (30) and a second drive device (31). The first drive device (30) is connected to the first drill (10) such that in use it can drive the first drill (10) about its longitudinal axis, and the second drive device (31) is connected to the drive end (27) of the second drill (10) such that in use it can drive the second drill (10) about its longitudinal axis. The connection is by known direct or indirect means.

In this case the dimensions and configuration, which may include the flight spacing, flight angle, flight depth, flight length, rotational speed, diameter, etc, of each drill (10,11), or part of each drill (10,11), are such that (in use) the second drill (11) has a volumetric feed rate greater than or equal to that of the first drill (10). It is thought that the volumetric feed rate of the second drill should be at least 1.0×, preferably 2× to 4× that of the first drill (10), but it could be 10× or more.

As one preferred method of using the machine can be used for many of the embodiments it will be described in detail after the first four embodiments are described in detail with any differences highlighted where appropriate.

Figure 4:
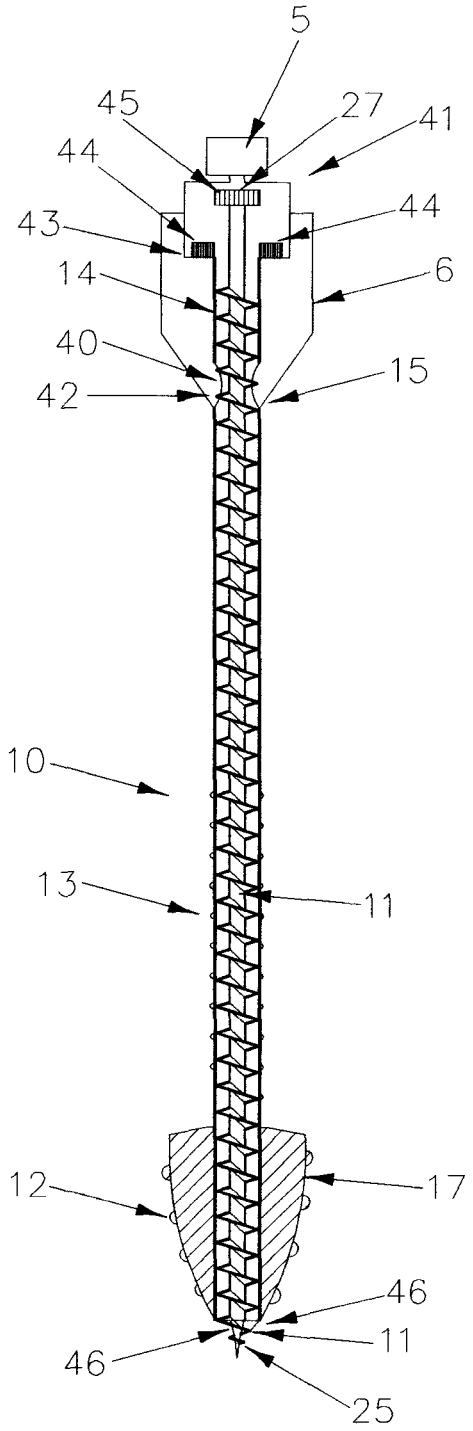
FIG. 4 is a cross sectional view of a second embodiment, along I-I in the direction of arrows I-I, of the machine, as the drill is inserted into the ground.
Figure 5:
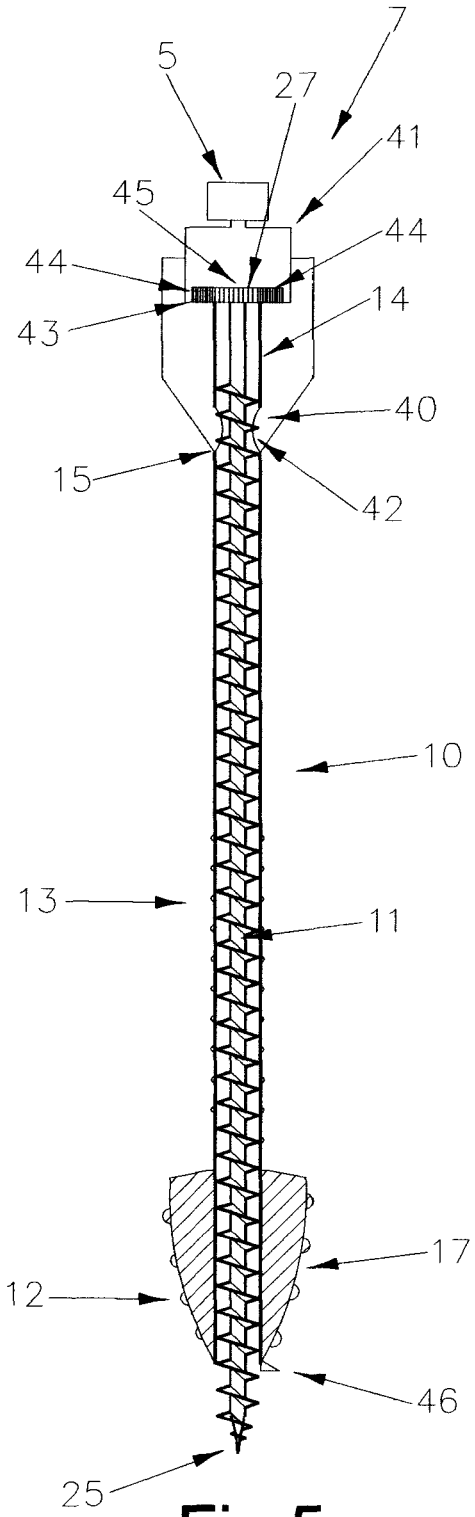
FIG. 5 is a cross sectional view of a second embodiment, along I-I in the direction of arrows I-I, of the machine, as the drill is extracted from the ground.

Referring to FIGS. 4 and 5 a second embodiment of the drill assembly (7) is shown in cross section, similar to that used for the first embodiment. In this second embodiment the third section (14) extends through the hopper (6) and includes an inlet section (40) and a gearbox section (41).

The gearbox section (41) forms the terminal end of the first drill (10) and the inlet section (40) is adjacent this. The inlet section (40) includes a plurality of inlets (42) spaced radially about the third section (14). Each inlet (42) is an aperture through the first drill (10) that is dimensioned to allow an aggregate (crushed stone, sized stone, other fill material) contained within the hopper (6) to pass from the hopper (6) to the second drill (11) when the machine (1) is in use.

The gearbox section (41) includes a first gear (43), at least one intermediate gear (44), a second gear (45) and a drive device (5). The drive device (5) is connected to the first drill (10), and in use drives the first drill (10) about its longitudinal axis. The second gear (45) is concentrically attached to the drive end (27) of the second drill (11), and the first gear (43) is attached inside the gearbox section (41). The intermediate gear(s) (44), when in the driving position (FIG. 5) drivingly connect the first gear (43) and the second gear (45) forming a star epicyclic gear; with the first gear (43) being the annular or ring gear, the intermediate gears (44) being the planetary gears and the second gear (45) being the sun gear. Said star epicyclic gear, when in use, transfers the drive from the drive device (5) to the first drill (10) and the second drill (11).

In FIG. 4 the gearbox section (41) is shown in the disengaged position, where the second gear (45) is separated from the intermediate gears (44); in this position the intermediate and second gears (44,45) are not enmeshed and no drive is transmitted from the intermediate gears (44) to the second gear (45). This separation is maintained as the force on the drill point (25) as the drill assembly (7) is inserted; when the drill assembly (7) is being withdrawn the drill point (25) pulls the second drill (11) down through the first drill until the intermediate and second gears engage (44,45).

In the first and second embodiments it is possible to have a blanking means (46) at the drill point (25). When present this blanking means (46) prevents the ingress of the ground into the aggregate at the drill point end (25) of the drill assembly (7) as the drill assembly (7) is inserted into the ground. The blanking means (46) may be as simple as a flap of material that is moved out of the way as soon as the second gear (45) or second drive device engages, or it could be a concrete cone sometimes used in the industry.

Figure 6:
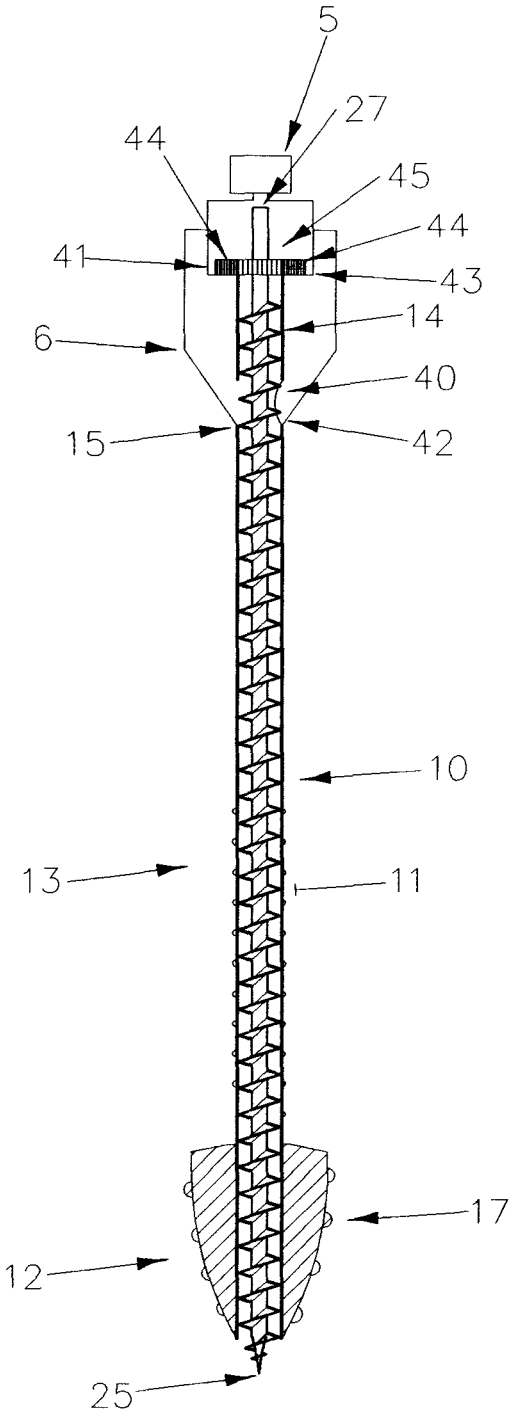
FIG. 6 is a cross sectional view of a third embodiment, along I-I in the direction of arrows I-I, of the machine.

Referring to FIG. 6 a cross sectional view of a third embodiment is shown, this embodiment is similar to the second embodiment. In this third embodiment the first, intermediate and second gears (43,44,45) are permanently engaged, accepting that there may be manual or automatic means of disengaging them for specific reasons (trying to free a binding drill, reversing one drill (10,11) to extract it because of damage etc). The first flight (20) and the drill flight (26) in this embodiment run the same direction, with the second flight (22) running in the opposite direction. FIG. 6 shows the first and drill flights (20,22) running the same direction as a right hand thread and the second flight running (26) the same direction as a left hand thread, but they could equally be the opposite handedness. The dimensions and configuration, which may include the flight spacing, flight angle, flight depth, flight length, rotational speed, diameter, etc, of each drill (10,11), or part of each drill (10,11), are such that (in use) the second drill (11) has a volumetric feed rate greater than that of the first drill (10). It is thought that the volumetric feed rate of the second drill should be at least 1.0×, preferably 2× to 4× that of the first drill (10).

Figure 6A:
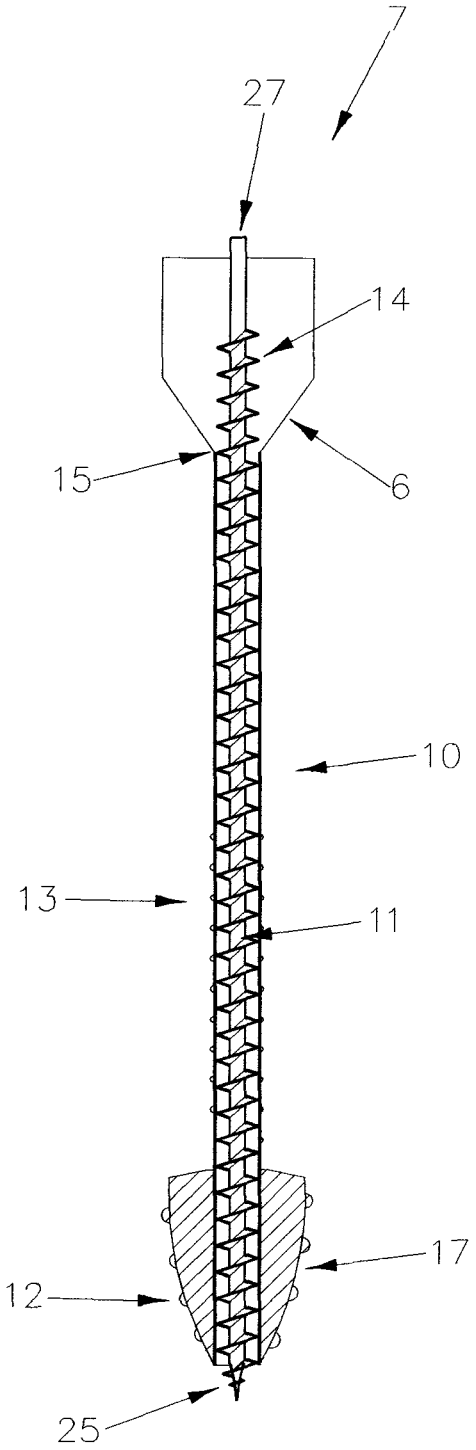
FIG. 6*a* is a cross sectional view of a fourth embodiment, along I-I in the direction of arrows I-I, of the drill assembly and hopper.

Referring to FIG. 6*a* a fourth embodiment is shown, the fourth embodiment similar to the first embodiment but the first and drill flight (20,26) of the respective drill (10,11) both run in the same direction as a right hand thread. In this case the dimensions and configuration, which may include the flight spacing, flight angle, flight depth, flight length, rotational speed, diameter, etc, of each drill (10,11), or part of each drill (10,11), are such that (in use) the second drill (11) has a volumetric feed rate greater than that of the first drill (10). It is thought that the volumetric feed rate of the second drill should be at least 1.0×, preferably 2× to 4× that of the first drill (10).

It should be noted that there is no requirement for the flights (20,22,26) to have a constant spacing, angle or outside diameter and though these variations are not shown in detail they may well be implemented for certain materials or purposes.

Figure 7:
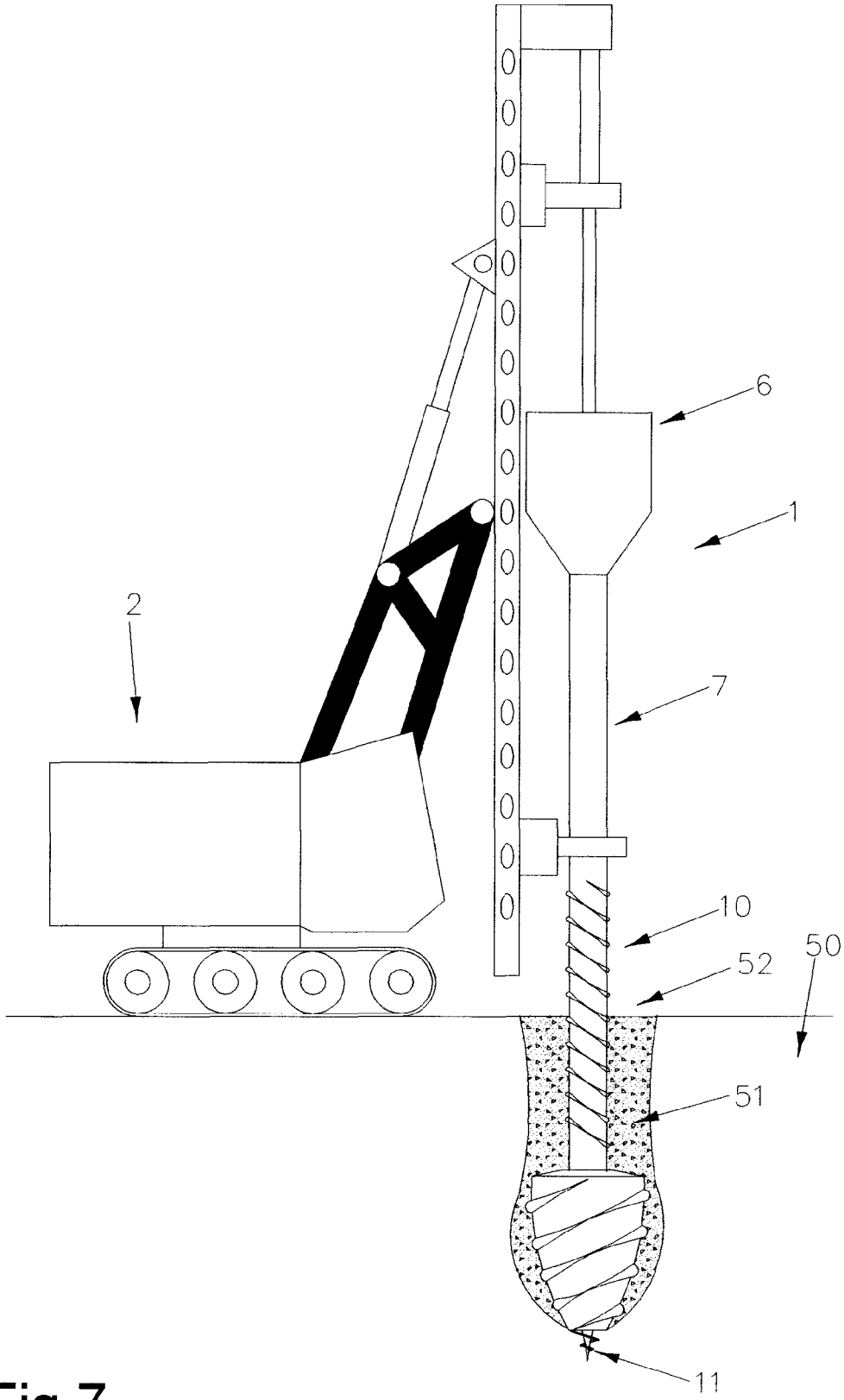
FIG. 7 is a side figurative view of the machine for forming granular columns mounted onto to a crane/excavator, as the drill assembly is being driven into the ground.
Figure 8:
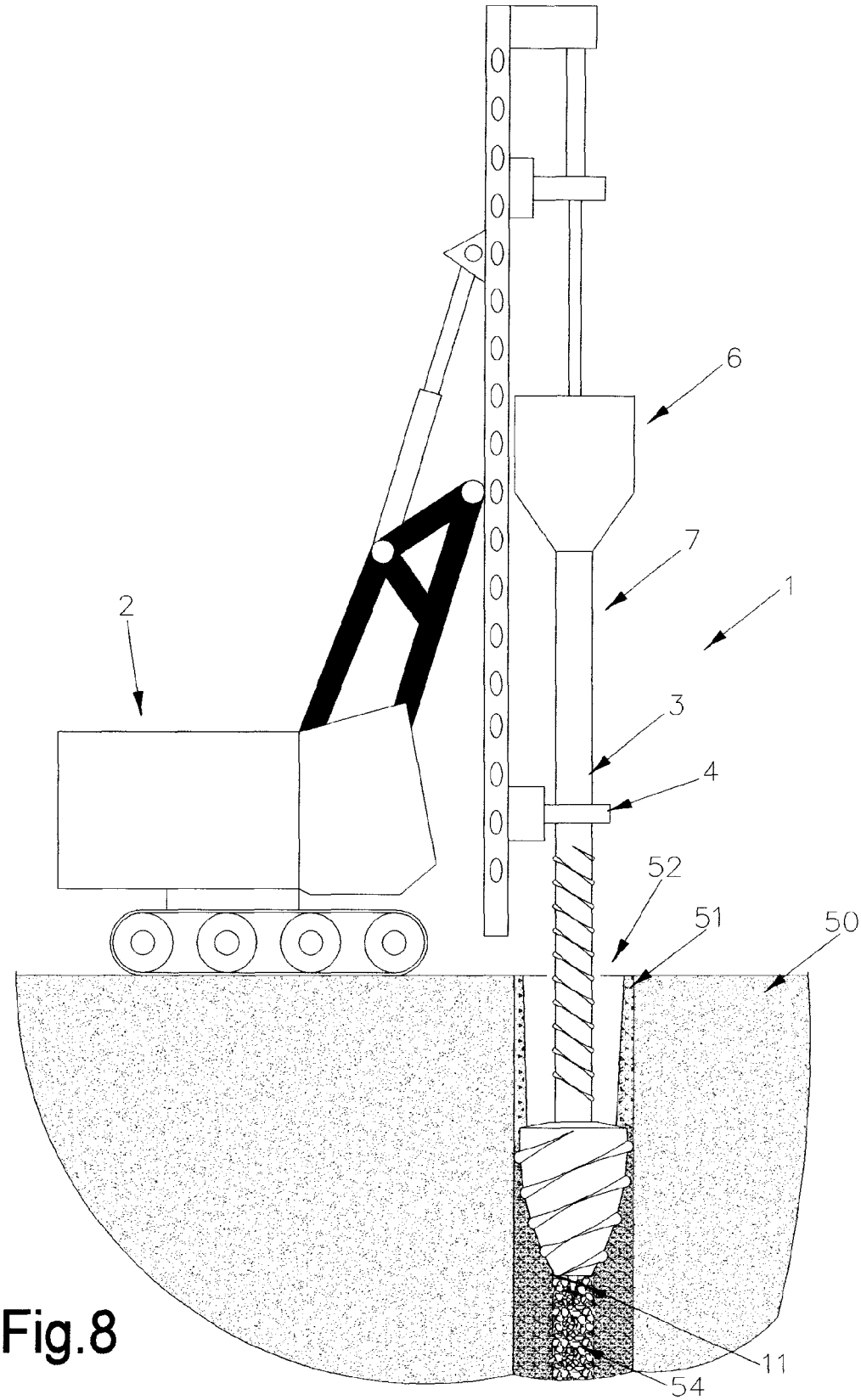
FIG. 8 is a side figurative view of the machine for forming granular columns mounted onto to a crane/excavator, as the drill assembly is being withdrawn from the ground and the granular column is being formed.

Referring to FIGS. 7 and 8, a first preferred method of operating the invention is shown. Where necessary, differences in operation of each of the embodiments above will be highlighted, and in those cases the drawings relating to those embodiments should be referred to for clarity.

After the machine (1) is properly located and aligned the first drill (10) is driven clockwise by the drive means (5,30) to which it is connected. In the case of the first embodiment the second drive device (31) is also started to prevent ingress of the ground (50) into the first drill (10). The drill assembly (7) is then pushed into the ground (50) at a rate dependent on the ground (50) properties. The spoil from the first section (12) of the first drill (10) is forced outwards to form a compressed wall (51) surrounding the hole (52) formed. The reverse direction of the second flight (22) reduces or eliminates any spoil being ejected from the hole (52), instead forming the compressed wall (51).

As the drill assembly (7) is inserted the expanded section (17) assists in forming the compressed wall (51) but it also aids in reducing the skin friction.

When the drill assembly (7) reaches full depth the drill assembly (7) is withdrawn from the hole (52). In the case of the second embodiment the withdrawal of the drill assembly (7), and the rotation of the second drill (11) releases the blanking means (46).

The second drill (11) now feeds aggregate from the hopper (6) into the base of the hole (52). The speed of withdrawal of the drill assembly (7) and the volumetric feed rate of the second drill (11) determines the compression/compaction of the granular column (54) formed. The speed of extraction and second drill (11) can be varied as the drill assembly (7) is withdrawn to create a granular column (54) with different compression/compaction zones. The diameter of the granular column (54) formed is essentially the same diameter as the expanded section (17).

In a further embodiment (not shown) the direction of the flights is reversed.

In a further embodiments there may be no expanded section (17).

Figure 9:
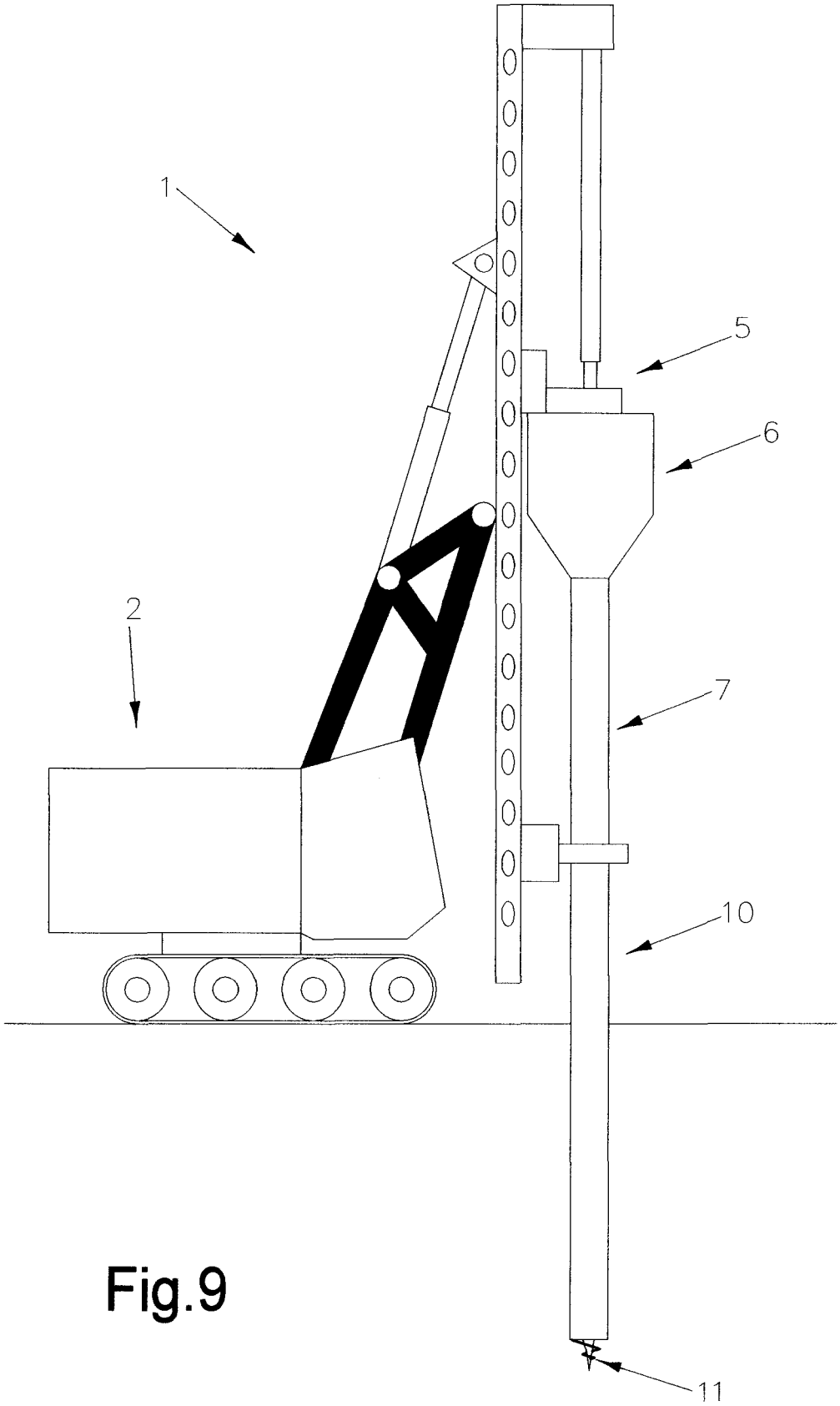
FIG. 9 is a figurative view of a fifth embodiment of the machine for forming a granular column in the ground.

Referring to FIG. 9 a fifth embodiment of a machine (1) for forming a granular column in the ground is shown mounted on an excavator/crane (2). The crane/excavator (2) is of a known type used in the industry and it provides the support and services to the machine (1). The machine (1) includes one or more drive device (5), a hopper (6) and drill assembly (7). The drill assembly (7) includes a first drill (10) and a second drill (11). The, or each, drive device (5) is a standard drive means, it could be a hydraulic motor, electric motor, diesel (or any other fuel) engine or other means of directly or indirectly rotationally driving an item. In this embodiment the first drill (10) is a tube with no flights or expanded section (17) being present.

Figure 10:
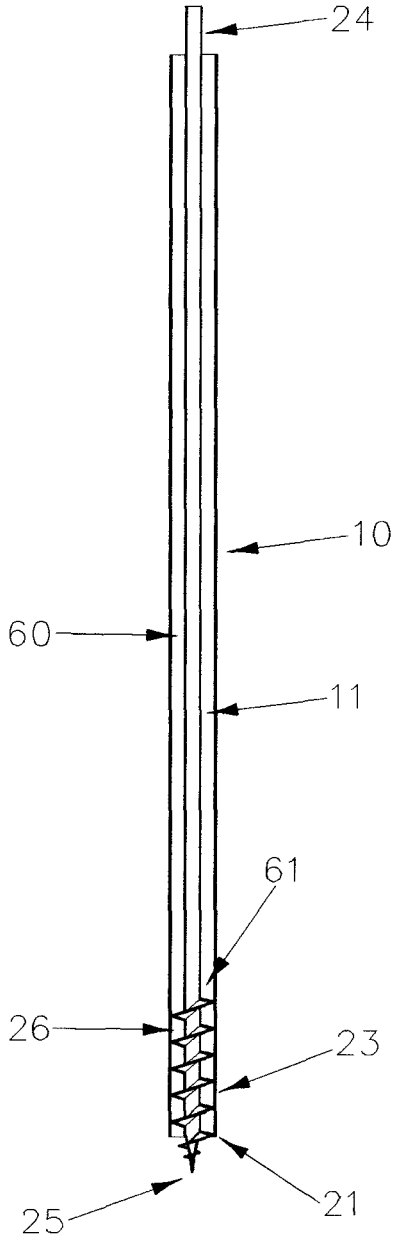
FIG. 10 is a cross sectional view of the drill assembly of the fifth embodiment with a first variation of the second drill.
Figure 11:
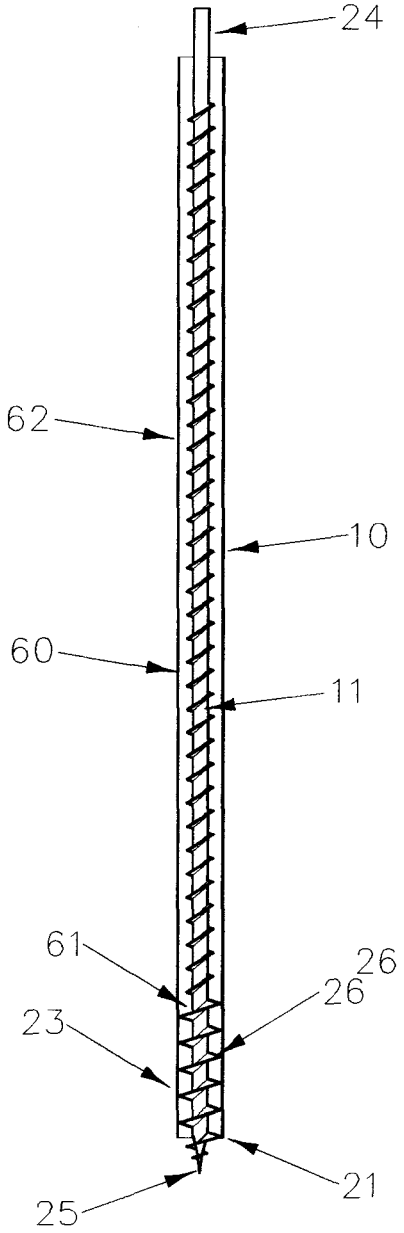
FIG. 11 is a cross sectional view of the drill assembly of the fifth embodiment with a second variation of the second drill.

Referring to FIGS. 10 and 11 a cross sectional view of the drill assembly (7) is shown, and although described and shown as used for this fifth embodiment the same variations of the second drill (11) can be used for other embodiments. FIG. 10 shows a first variation of the second drill (11) and FIG. 11 shows a second variation of the second drill (11), in both variations there is an intermediate section (60) between the primary section (23) and the secondary section (24) of the second drill (11). The drill flight (26) has a first terminal end (61) where the primary section (23) and intermediate section (60) are coterminous.

The drill flight (26), in these variations, runs in the direction required to feed aggregate into the ground (50) when the second drill (11) is in use and being rotated in the normal direction.

In the first and second variations of the second drill (11) the drill flight (26) extends only along the primary section (23). The primary section (23) is between 300 mm and 1.5 m in length, and between 100 mm and 1.5 m in diameter, though these dimensions may vary depending on the overall dimensions of the drill assembly (7).

The second variation of the second drill (11) has a fourth flight (62) which has a smaller outside diameter than the drill flight (26). Both the drill flight (26) and the fourth flight (62) run in the same direction, and though likely to have the same pitch this may vary. There is no need for the drill flight (26) to lead into the fourth flight (61) or the fourth flight (61) to be continuous.

Figure 12:
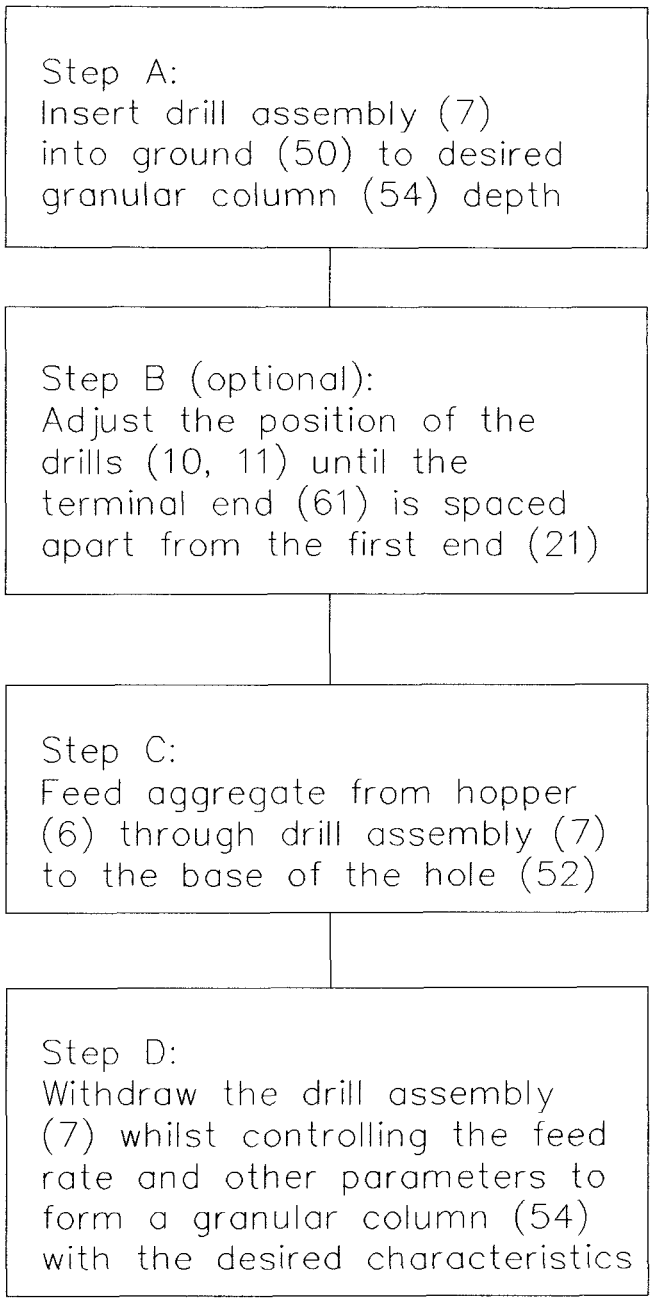
FIG. 12 is a flowchart of the method of using the granular column machine.

In a further variation the drill flight (26) extends only along the primary section (23) but decreases in outside diameter towards the first terminal end (61), possibly reducing to a short section of constant diameter. This configuration has been found to also assist the feed of material Referring to FIG. 12 a flowchart outlining a preferred method of using the first or second variations of the second drill (11) is shown, said method includes the following steps:

Step A: Insert drill assembly (7) into the ground (50) to the desired granular column (54) depth;

Step B: Adjust the position of the drills (10,11) until the first terminal end (61) is spaced apart from the first end (21);

Step C: Feed aggregate from the hopper (6) through the drill assembly (7) to the base of the hole (52);

Step D: Withdraw the drill assembly (7) whilst controlling the feed rate and other parameters to form a granular column with the desired characteristics.

It should be noted that step B is optional and it is omitted for the first to fourth embodiments described previously.

We will describe the method in detail for the fifth embodiment, noting that a similar method could be used for any of the embodiments if step B is omitted, or the second drill (11) has a configuration similar to that used for the fifth embodiment.

In step A the drill assembly (7) is pushed into the ground by the excavator/crane (2), this may be assisted by the drive means (5) rotating the first drill (10) or drill assembly (7). As the drill assembly (7) is forced into the ground (50) the first drill (10) displaces the ground material forming a compressed wall (51). To prevent any detrimental amount of ground material entering the centre of the first drill (10) the second drill (11) is rotated, alternatively blanking means (46) are present that prevents the ground material moving along the drill flight (26) during this step. It should be noted that a detrimental amount of ground material is an amount of ground material sufficient to affect the integrity of the granular column (54) formed. Once the drill assembly (7) is at the required depth the excavator/crane (2) stops forcing the drill assembly (7) into the ground (50) and step B is undertaken.

It should be noted that where the term 'forced' is used with reference to the insertion of the drill assembly (7) this force is only sufficient to push the drill assembly (7) into the ground at the desired rate and it may be negligible if the first drill (10) is rotated, is rotated and includes flights, includes an expanded section or a combination of these or other features.

Figure 13:
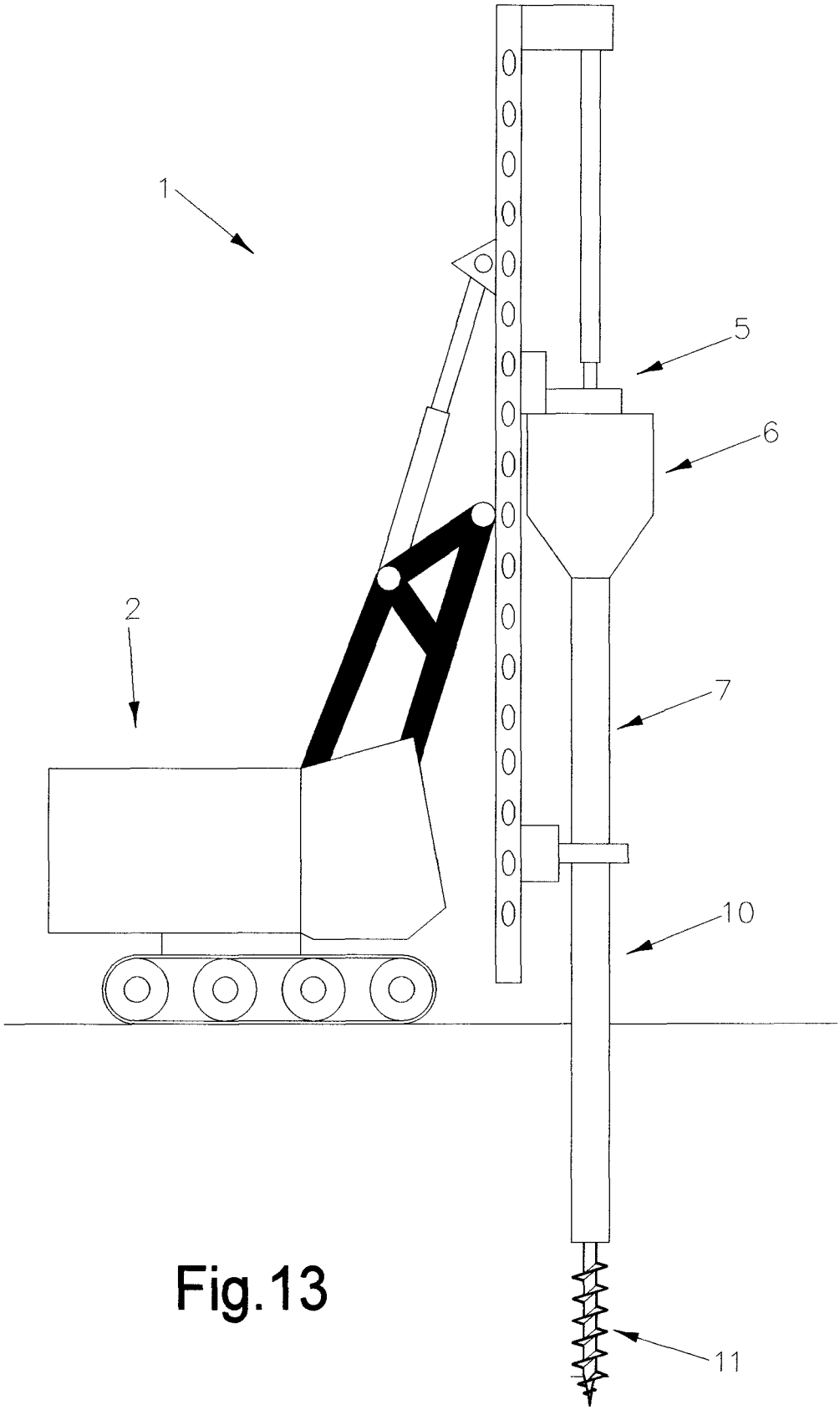
FIG. 13 is a figurative view of the granular column machine with the fifth embodiment drill assembly with the first drill and second drill in position to form the granular column.

In step B, when undertaken, the relative vertical positions of the first and second drills is adjusted until the terminal end (61) of the primary section (23) is spaced apart (vertically displaced) from the first end (21) of the first drill (10). This may be accomplished by forcing the second drill (11) further into the ground (50), withdrawing the first drill (10) a small amount or a combination of these. The drills (10,11) in this position are shown in FIG. 13 for clarity. If blanking means (46) are present then these can be dislodged by a momentary reversal of the second drill (11) before step B is undertaken, or dislodged as step B is undertaken. The blanking means (46) may be retained by a breakable link (a small weld for example) between the first and second (10,11) drills, be hinged/pivoted flaps, a combination of these or any other suitable means to prevent the ingress of foreign material into the first drill (10). It should be noted that the vertical separation may involve the second drill (11) being withdrawn into the first drill (10) or vice versa.

A vertical separation of around 100 mm between the terminal end (61) and the first end (21) for aggregate below about 65 mm in size has been found to prevent bridging/binding of the aggregate, but this distance is thought to be determined by the aggregate size and composition, the diameter of the drills (10,11), the configuration of the drill flight (26) and/or a combination of these parameters. Step C is then actioned In step C the aggregate is allowed to pass from the hopper (6), or a storage area, through the centre of the first drill (10) to the base of the hole (52). This step will normally require that the second drill (11) is driven by the drive means (5), directly or indirectly in the direction that feeds the aggregate along the third, and where present, fourth flights (26,62) to the base of the hole (52) to start forming the granular column (54). Step D is then undertaken to form a granular column (54) with the desired characteristics.

In step D the aggregate is fed to the base of the hole (52) whilst the drill assembly is withdrawn at a controlled rate and the second drill (11) is rotated at a controlled rate.

Various parameters are measured and controlled to form a granular column (54) with the desired characteristics, these characteristics include the density and porosity of the column at any point. The parameters measured and controlled include one or more of rotational speed and direction of the drills (10,11) and or drill assembly (7), the speed the drill assembly (7) is withdrawn, the aggregate feed rate, the drill (10,11)/drill assembly (7) torque requirement, additive feed rate etc. By controlling the torque requirements of the second drill (11) and the feed rate of aggregate the density of the granular column (54) at any point can be controlled. It is believed that it is possible to force 6 cubic meters of uncompacted aggregate into a 1 cubic meter column.

If the first drill (10) and second drill (11) are spaced apart then the spacing may be varied to vary the granular column (54) properties.

By controlling the composition of the granular column (54) at any point it is possible to create zones in the column which have increased density, increased porosity for drainage at specific levels, or other specific properties. It should also be noted that the aggregate size/composition/structure can be varied by feeding in different materials into the hopper (6). For example cement covered aggregate could be used to form a more coherent column where liquefaction was likely.

It should be noted that these variations of the second drill (11) can be used with any compatible embodiment described and it is envisioned that the first and second drills (10,11) of this embodiment could be driven by an epicyclic gearbox.

Providing there are blanking means (46), or some volumetric feed rate difference between the first drill (10) and the second drill (11), then it is possible to ensure that minimal ground material ingress into the centre of the first drill (7) occurs as the drill assembly (7) is inserted into the ground (50). That is a detrimental amount of ground material is excluded. Noting that the volumetric feed rate refers to the volume of material displaced or capable of being moved in a set time by that drill (10,11). For example if the first drill (10) displaces 1 cubic meter of ground for each 1 m of length and it is fed into the ground at a rate of 1 m/second then the volumetric feed rate of the first drill (10) is 1 cubic meter/second. If the configuration of the second drill (11) is such that if it is rotated at 10 rpm it moves 60 cubic meters of aggregate from the hopper (6) to the primary section (23), then it also has a volumetric feed rate of 1 cubic meter/second.

In a further embodiment (not shown) there may be no hopper (6) present or the hopper (6) is not attached to the drill assembly (7) until the aggregate needs to be fed through the inlets or into the centre of the first drill (10). Alternatively the aggregate may be fed as needed into the drill assembly by any suitable means.

In certain embodiments the composition of the aggregate may be varied as the granular column (54) is formed, for example in some cases the initial aggregate may have a size range of 10 mm to 20 mm then as the granular column is formed larger and smaller size ranges of aggregate are used to form drainage paths and/or impermeable sections.

To prevent binding of the aggregate it may be advantageous to feed water, a lubricating slurry or a similar lubricating material in with the aggregate as the granular column (54) is formed.

Figure 14:
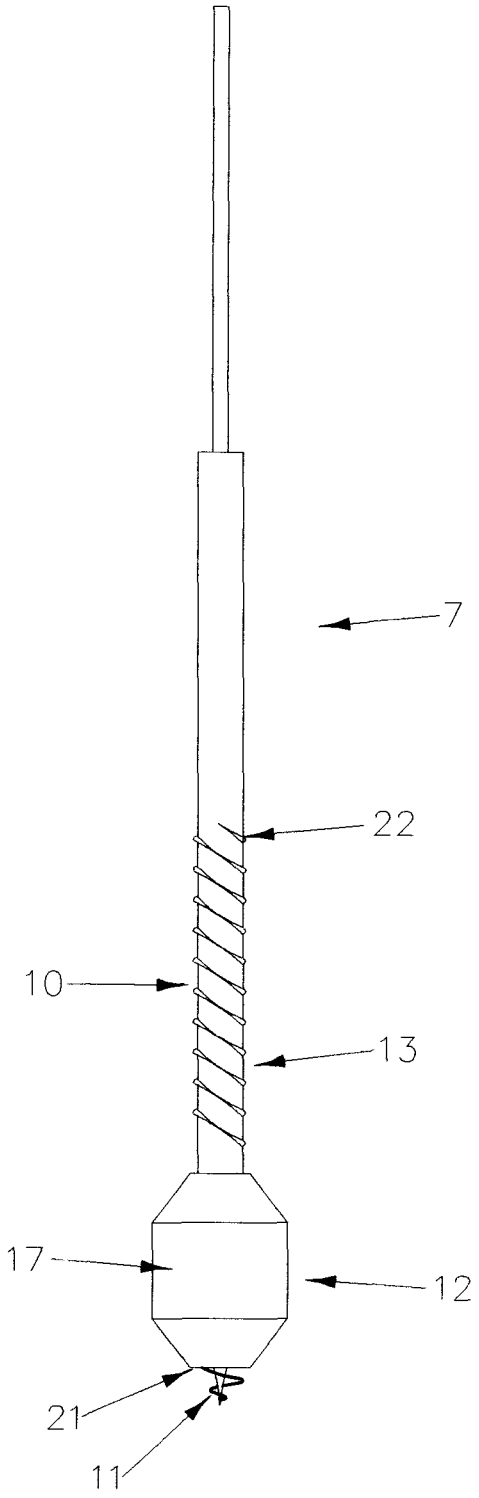
FIG. 14 is a side view of the drill assembly of the sixth embodiment.

In FIG. 14 a sixth embodiment of the drill assembly (7) is shown, in this embodiment the first section (12) includes an expanded section (17) of the drill assembly (7) which is larger in outside diameter than the second section (13). The expanded section (17) has no flights attached. The outside diameter of the first section (12) smoothly transitions from the outside diameter of a first end (21) of the first section (12), where the first end (21) is coterminous with a terminal end of the first drill (10), to the outside diameter of the expanded section (17), it then smoothly transitions to the outside diameter of the second section (13). In one form the first section (12) is essentially two truncated cones, bases facing, with a cylinder inserted between them. In this sixth embodiment the second section (13) includes a second flight (22) attached to the outer surface of the second section (13). The second flight (22) runs the same direction as a left hand thread. The expanded section (17) reduces the skin friction during use but includes a second flight (22) that aids in the formation of the compressed outer wall (51) (not shown in FIG. 14) as the drill assembly (7) is inserted.

The sixth embodiment can be used with any of the methods described.

It must be accepted that though the present invention essentially eliminates the spoil, that is the spoil ejected is less than about 5%, there may be some deformation of the surface of the ground in some circumstances. In many cases the land deformation will be the only 'spoil'.

KEY

1 machine;
2 Crane/excavator;
3 ;
4 ;
5 Drive device;
6 hopper;
7 drill assembly;
8 ;
9 ;
10 first drill;
11 second drill;
12 first section; —$1^{st}$ drill
13 second section; $1^{st}$ drill
14 third section; $1^{st}$ drill
15 base; —of hopper
16 ;
17 expanded section; —of $1^{st}$ drill
18 ;
19 ;
20 First flight;
21 First end; —$1^{st}$ section
22 Second flight; —$2^{nd}$ section
23 Primary section; —$2^{nd}$ Drill
24 Secondary section; —$2^{nd}$ Drill
25 Drill point; —first embodiment
26 Drill flight; —$2^{nd}$ drill
27 Drive end; —$2^{nd}$ drill
28 ;
29 ;
30 First drive device; —embodiment 1
31 Second drive device; —embodiment 1
40 Inlet section; $2^{nd}$ embodiment $3^{rd}$ section;
41 Gearbox section; $2^{nd}$ embodiment $3^{rd}$ section;
42 Inlet;
43 First gear;
44 Intermediate Gear;
45 Second gear;
46 Blanking means;
47 ;
50 Ground;
51 Compressed wall;
52 Hole;
53 ;
54 Granular column;
60 Intermediate section (first and second variations of second drill);
61 First terminal end (of drill flight);
62 Fourth flight (intermediate section, second variation of second drill);

The invention claimed is:

1. A drill assembly for forming in ground granular columns without the need for vibratory compaction, comprising:

a first drill and a second drill, where the first drill is a tube, and the second drill includes a drill flight, wherein said first and second drills are concentric, and the second drill is configured to lie at least partially within the first drill, such that the drill assembly is configured to form the granular column with primarily vertical compaction; and said first drill includes a first section, a second section and a third section, where the second section lies between the first section and the third section, such that the first section includes an expanded section which is a section of the first drill that has a greater diameter than the second section.

2. The drill assembly of claim 1, wherein the first section includes a first end which is coincident with a terminal end of the first drill.

3. The drill assembly of claim 1, wherein the second drill includes a primary section and a secondary section where the primary section includes the drill flight.

4. The drill assembly of claim 3, wherein, the primary section is configured to be adjacent the first section of the first drill during insertion of the drill assembly.

5. The drill assembly claim 3, wherein the drill flight includes a first terminal end which is closest to the secondary section.

6. The drill assembly claim 5, further comprising an intermediate section, between the primary section and the secondary section, such that the first terminal end of the drill flight is coterminous with one distal end of the intermediate section.

7. The drill assembly of claim 6, wherein the intermediate section includes a fourth flight.

8. The drill assembly of claim 1, wherein the expanded section is configured, when the first drill is in use, to reduce the skin friction of the drill assembly.

9. The drill assembly of claim 1, further comprising a hopper which is configured to feed aggregate to the drill assembly.

10. The drill assembly of claim 1, wherein the second drill includes a drill point coincident with a terminal end of the second drill which is configured to be the first part of the second drill to engage with the ground.

11. The drill assembly of claim 1, wherein the drill assembly includes means, or is configured to be operated such, that in use, the ingress of ground material into the first drill is below a level likely to contaminate the completed granular column.

12. The drill assembly of claim 1, wherein the second drill includes a blanking means configured to prevent the ground from entering the second drill during insertion of the drill assembly into the ground.

13. A method of forming a granular column comprising:

pushing a drill assembly into ground, forming a hole said drill assembly comprising a first drill and a second drill, where the first drill is a tube, and the second drill includes a drill flight, wherein said first and second drills are concentric, and the second drill is configured to lie at least partially within the first drill, such that the drill assembly is configured to form the granular column with primarily vertical compaction; and said first drill includes a first section, a second section and a third section, where the second section lies between the first section and the third section, such that the first section includes an expanded section which is a section of the first drill that has a greater diameter than the second section;

stopping the drill assembly at a predetermined depth;

feeding an aggregate to a terminal end of the drill assembly, using said second drill; and withdrawing the drill assembly while forming a granular column.

14. A method of forming an in ground granular column using a drill assembly, comprising:

Inserting a drill assembly into ground to a desired depth to form a hole, said drill assembly comprising a first drill and a second drill, where the first drill is a tube, and the second drill includes a drill flight, wherein said first and second drills are concentric, and the second drill is configured to lie at least partially within the first drill, such that the drill assembly is configured to form the granular column with primarily vertical compaction; and said first drill includes a first section, a second section and a third section, where the second section lies between the first section and the third section, such that the first section includes an expanded section which is a section of the first drill that has a greater diameter than the second section;

Feeding an aggregate through the drill assembly to a base of the hole; and

Withdrawing the drill assembly, whilst controlling at least a feed rate, to form a granular column with the desired characteristics.

15. A granular column formed by: Inserting a drill assembly into ground to a desired depth to form a hole;

Feeding an aggregate through the drill assembly to a base of the hole, said drill assembly comprising a first drill and a second drill, where the first drill is a tube, and the second drill includes a drill flight, wherein said first and second drills are concentric, and the second drill is configured to lie at least partially within the first drill, such that the drill assembly is configured to form the granular column with primarily vertical compaction; and said first drill includes a first section, a second section and a third section, where the second section lies between the first section and the third section, such that the first section includes an expanded section which is a section of the first drill that has a greater diameter than the second section; and Withdrawing the drill assembly, whilst controlling at least a feed rate, to form a granular column.

* * * * *